US005570792A

United States Patent [19]

Huang

[11] Patent Number: 5,570,792

[45] Date of Patent: Nov. 5, 1996

[54] HANGING FILE STORAGE UNIT

[76] Inventor: Kuo-Feng Huang, P.O. Box 82-144, Taipei, Taiwan

[21] Appl. No.: 607,979

[22] Filed: Feb. 29, 1996

[51] Int. Cl.[6] ..... A47F 7/16

[52] U.S. Cl. ..... 211/46; 211/189; 312/184

[58] Field of Search ..... 211/46, 189, 175, 211/207; 312/184

[56] References Cited

U.S. PATENT DOCUMENTS

| | | | |
|---|---|---|---|
| 2,226,570 | 12/1940 | McCaw | 211/189 |
| 3,944,080 | 3/1976 | Hansen | 211/46 |
| 5,170,895 | 12/1992 | Chedzik | 211/46 |
| 5,515,980 | 5/1996 | Fotioo | 211/46 |

*Primary Examiner*—Ramon O. Ramirez
*Assistant Examiner*—Michael J. Turgeon
*Attorney, Agent, or Firm*—Alfred Lei

[57] ABSTRACT

A hanging file storage unit including four supporting plates each provided with a plurality of vertical and horizontal tubular portions at an inner side thereof, a plurality of longitudinal rods having two bent ends adapted to engage with respective vertical and horizontal tubular portions of the supporting plates, and a plurality of transverse rods having two bent ends adapted to engage with respective vertical an horizontal tubular portions of the supporting plates, whereby the storage unit can be easily adjusted to receive hanging files with different sizes.

2 Claims, 6 Drawing Sheets

HANGING FILE STORAGE UNIT

BACKGROUND OF THE INVENTION

1. Field of the Invention

This invention relates to an improved hanging file storage unit.

2. Description of the Prior Art

Heretofore, there are numerous kinds of hanging file storage units sold on the market, but none of them are satisfactory in use. FIG. 10 illustrates a typical hanging file storage unit commonly seen on the market. As shown, the hanging file storage unit includes four generally L-shaped legs A and two side bars B. The leg A is provided with a plurality of threaded holes A1 at its vertical side and its upper side, while the side bar B has a plurality of threaded holes B1 at both ends. The legs A are engaged with the side bars B by screws. Nevertheless, it is difficult and time-consuming to adjust the distance between the two side bars B so as to adapt to hanging files with different sizes. Furthermore, such a hanging file storage unit is unstable and will oscillate when subject to an external force.

Therefore, it is an object of the present invention to provide a hanging file storage unit which can obviate and mitigate the above-mentioned drawbacks.

SUMMARY OF THE INVENTION

This invention relates to an improved hanging file storage unit.

It is the primary object of the present invention to provide a hanging file storage unit which can be easily dismantled when not in use.

It is another object of the present invention to provide a hanging file storage unit which can be adjusted to be fit for hanging files with different sizes.

It is still another object of the present invention to provide a hanging file storage unit which is facile for transportation.

It is still another object of the present invention to provide a hanging file storage unit which is convenient to use.

It is a further object of the present invention to provide a hanging file storage unit which is low in cost.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
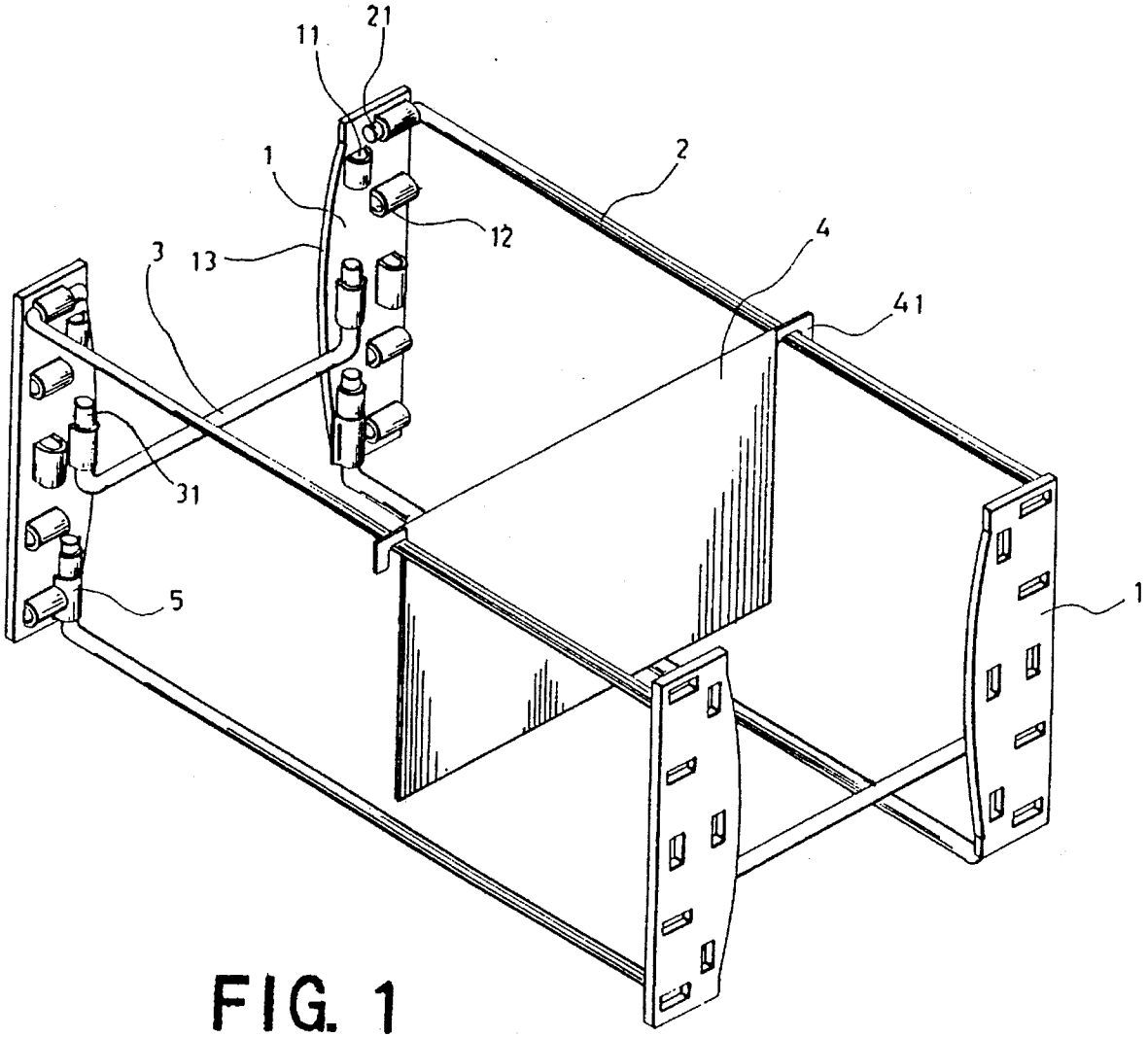
FIG. 1 is a perspective view of the present invention.

For the purpose of promoting an understanding of the principles of the invention reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
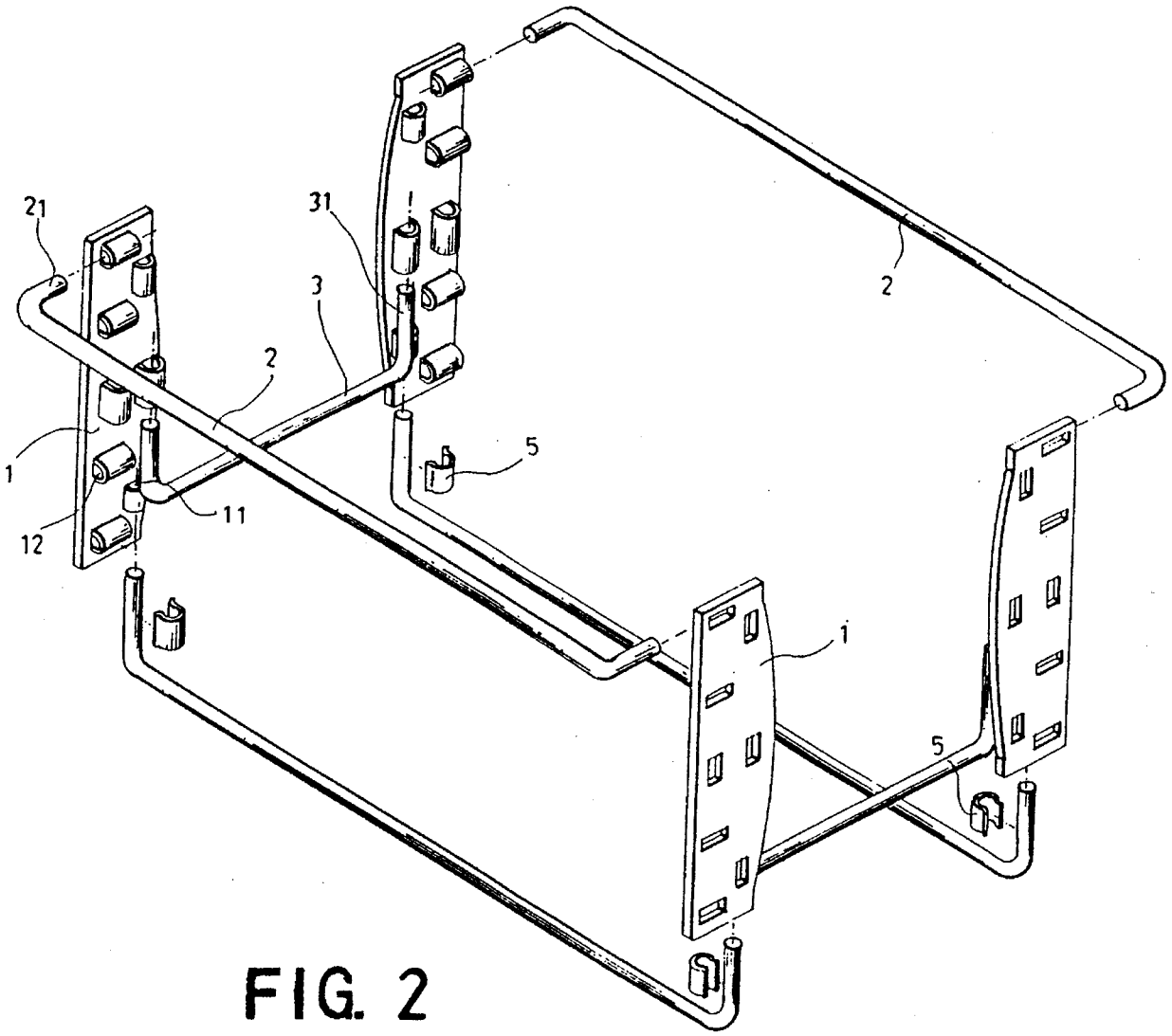
FIG. 2 is an exploded view of the present invention.

With reference to the drawings and in particular to FIGS. 1 and 2 thereof, the hanging file storage unit according to the present invention comprises four supporting plates 1, four longitudinal rods 2 and two transverse rods 3. The supporting plate 1 is formed with a plurality of vertical tubular portions ill and horizontal tubular portions 12 at its inner side. Further, the supporting plate 1 has a convex inner edge 13 for beautifying the outlook thereof. The longitudinal rod 2 is longer than the transverse rod 3. Both ends of the longitudinal rod 2 are bent to adapt to engage with the horizontal and the vertical tubular portions 12 and 11. Likewise, both ends of the transverse rod 3 are bent to adapt to engage with the horizontal and vertical tubular portions 12 and 11.

When in assembly, two longitudinal rods 2 are engaged with respective uppermost horizontal tubular portions 12 of the supporting plates 1 at their ends 21 and two longitudinal rods 2 are engaged with respective lowermost vertical tubular portions ill of the supporting plates 1. Two transverse rods 3 are engaged with respective vertical tubular portions ill of the supporting plates 1 at their ends 31 thereby enabling two hook ends 41 of a hanging file 4 to be suspended on the two longitudinal rods 2 at the upper position and therefore providing a storage unit for hanging files 4.

Figure 7:
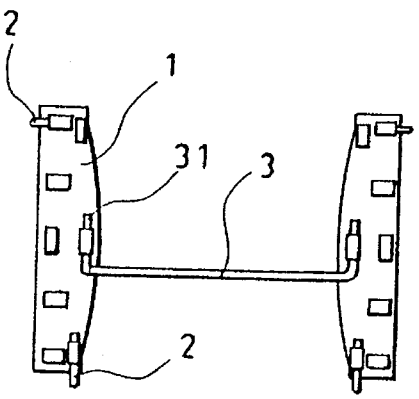
FIGS. 6, 7, 8 and 9 show different applications of the present invention; and FIG, 10 illustrates a prior art hanging file storage unit.
Figure 9:
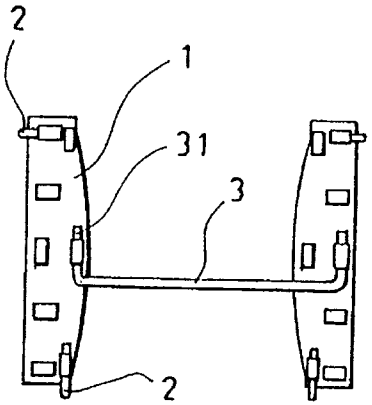
Figure 8:
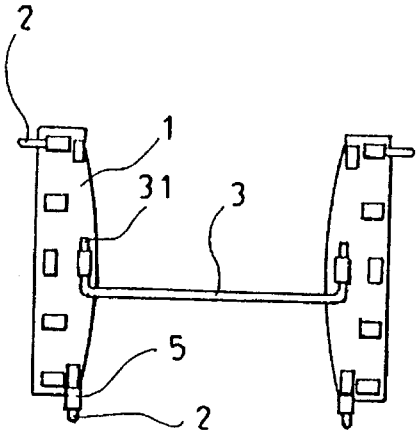
Figure 6:
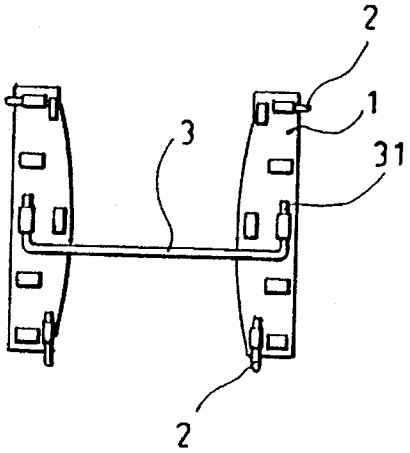
Figure 10:
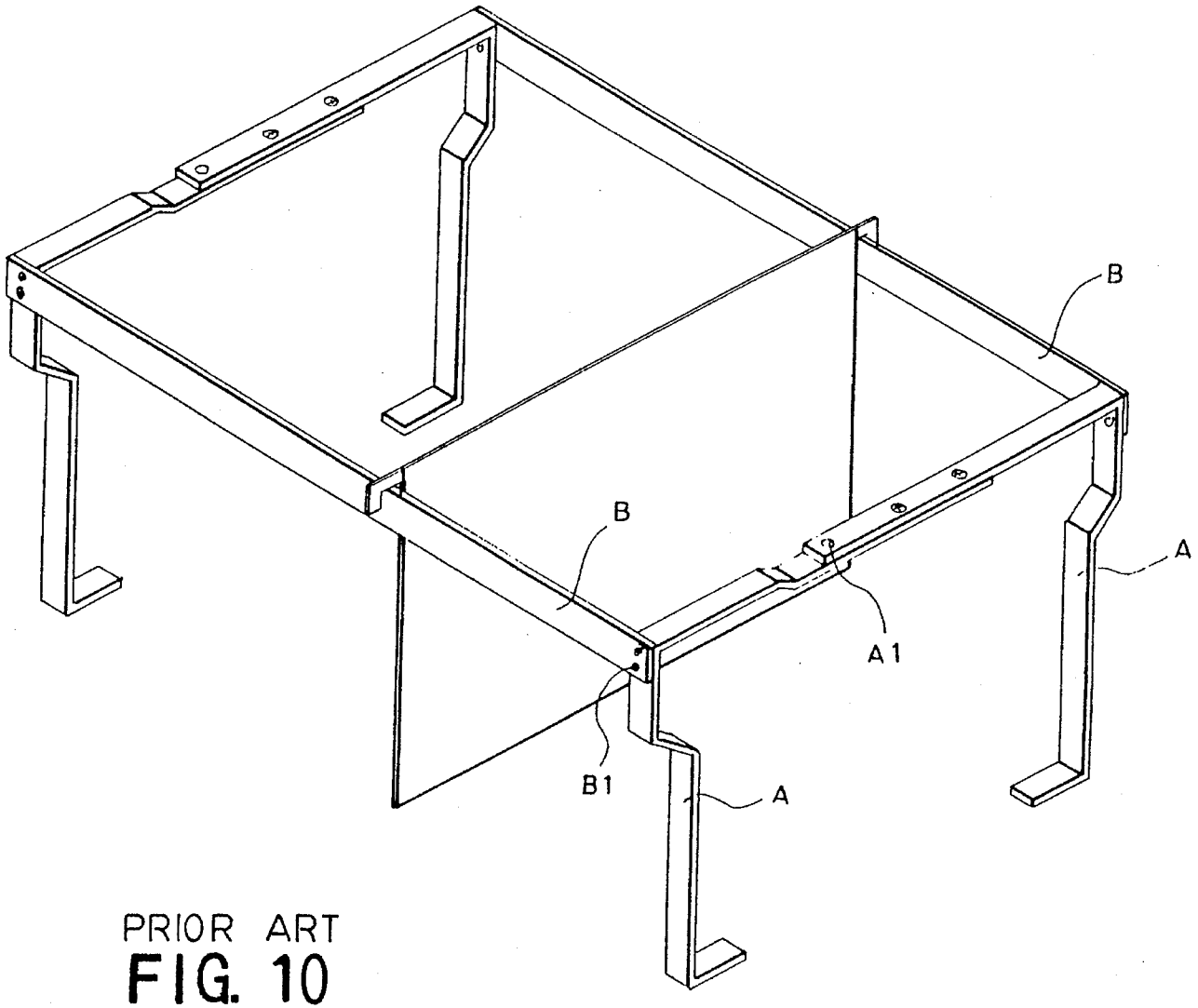
PRIOR ART FIG. 10

The distance between the two longitudinal rods 2 can be adjusted by engaging the longitudinal rods 2 with different vertical tubular portions ill of the supporting plates (see FIGS. 6, 7 and 9). Further, the longitudinal rods 2 at the upper position 2 may be moved outwards to increase the distance therebetween and the longitudinal rods 2 at the lower position may be moved downward to increase the height of the unit (see FIG. 8).

A resilient C-shaped retainer 5 (see FIGS. 1 and 2) may be used to engage with the ends of the longitudinal and transverse rods 2 and 3 so as to keep them in a fixed position.

Figure 3:
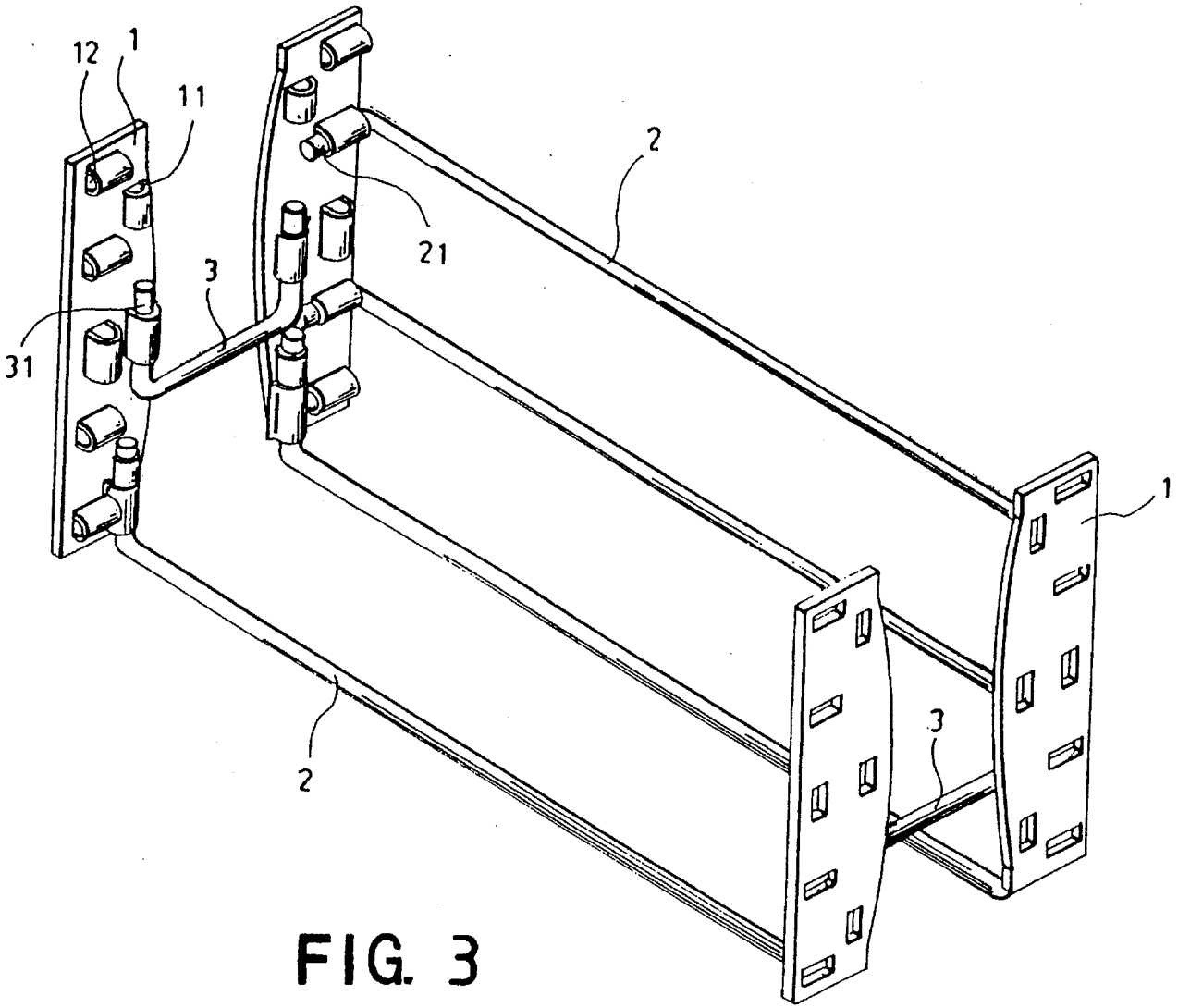
FIG. 3 illustrates how the present invention is used as a book shelf.
Figure 5:
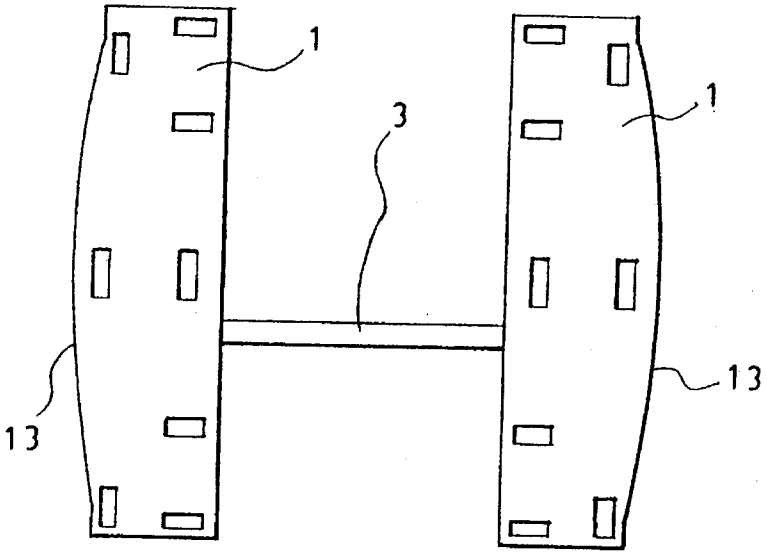
FIGS. 4 and 5 illustrate different positions of the supporting plates.
Figure 4:
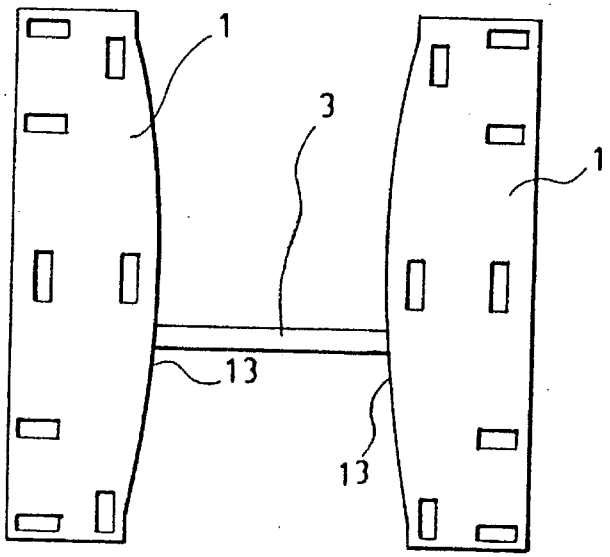

In addition, the engagement between the supporting plates 1 and the longitudinal rods 2 may be rearranged to form a book shelf as shown in FIG. 3. Moreover, the supporting plates 1 may be disposed at different positions as shown in FIGS. 4 and 5.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A hanging file storage unit comprising:

four supporting plates each provided with a plurality vertical and horizontal tubular portions at an inner side thereof;

a plurality of longitudinal rods having two bent ends adapted to engage with respective vertical and horizontal tubular portions of said supporting plates; and a plurality of transverse rods having two bent ends adapted to engage with respective vertical and horizontal tubular portions of said supporting plates.

2. The hanging file storage unit as claimed in claim 1, further comprising a plurality of resilient C-shaped retainer adapted to engage with bent ends of said longitudinal end transverse rods.

* * * * *